United States Patent [19]

Bergson

[11] Patent Number: 4,634,476

[45] Date of Patent: Jan. 6, 1987

[54] HIGH-STRENGTH, LOW-ALLOY CAST STEEL

[75] Inventor: Benjamin J. Bergson, Bellevue, Wash.

[73] Assignee: Paccar Inc, Bellevue, Wash.

[21] Appl. No.: 730,342

[22] Filed: May 3, 1985

[51] Int. Cl.[4] ..... C22C 38/12; C22C 38/22; C22C 38/44

[52] U.S. Cl. ..... 420/73

[58] Field of Search ..... 148/3, 36, 144, 143, 148/134, 12 F, 12 B, 12 R, 142, 12.3; 75/123 J, 123 B, 123 N, 125, 126 C, 126 J, 128 N, 128 W, 124, 126 E, 128 V

[56] References Cited

U.S. PATENT DOCUMENTS

| | | | |
|---|---|---|---|
| 3,155,496 | 11/1964 | Nakamura et al. | 75/124 B |
| 3,216,823 | 11/1965 | Gulya et al. | 75/125 |
| 3,303,061 | 2/1967 | Wilson | 75/125 |
| 3,463,677 | 8/1969 | Nakamura et al. | 75/124 BA |
| 3,664,830 | 5/1972 | Kambayashi et al. | 75/124 BA |
| 3,994,754 | 11/1976 | Geymond | 148/36 |

FOREIGN PATENT DOCUMENTS

| | | | |
|---|---|---|---|
| 27141 | 8/1971 | Japan | 148/143 |
| 14215 | 5/1975 | Japan | 148/12.3 |
| 4227 | 1/1979 | Japan | 75/125 |
| 24932 | 2/1980 | Japan | 148/143 |
| 140855 | 8/1982 | Japan | 75/123 J |
| 759614 | 8/1980 | U.S.S.R. | 75/128 V |

*Primary Examiner*—L. Dewayne Rutledge
*Assistant Examiner*—Deborah Yee
*Attorney, Agent, or Firm*—Seed and Berry

[57] ABSTRACT

The present invention relates to a high-strength, low-alloy, cast bainitic steel which has excellent weldability and ductility, and which maintains its toughness at low temperatures. The steel achieves these properties by having vanadium and a high nitrogen concentration while minimizing elements which decrease toughness, such as titanium. The analysis of the steel, by weight, is substantially as follows: by weight, substantially as follows:

0.07 to 0.12% carbon,
0.20 to 0.60% silicon,
0.90 to 1.20% manganese,
0.30 to 0.50% molybdenum,
0.05 to 0.10% vanadium,
0.009 to 0.015% nitrogen,
0.010 max. sulphur,
0.30% max. chromium,
0.30% max. nickel,
0.01% max. titanium,
0.35% max. copper,
0.07% max. aluminum, and
0.015% max. phosphorus, the remainder being essentially iron with incidental impurities.

4 Claims, No Drawings

HIGH-STRENGTH, LOW-ALLOY CAST STEEL

TECHNICAL FIELD

The present invention relates to high-strength, low-alloy bainitic cast steel possessing good weldability, ductility, and toughness at temperatures from 240° F. to −50° F. or lower.

BACKGROUND ART

The modern shipbuilding industry requires a very high-quality steel capable of performing reliably under harsh conditions. The steel must be strong enough to withstand unpredictable weather, heavy loads, and extended periods of use. The steel must retain its toughness even at low temperatures and must be weldable over a wide range of temperatures without pre-heating so that repairs and modifications can be made quickly and safely at sea. Finally, the relationship of strength to weight must be high in order to increase manueverability and decrease valuable fuel consumption.

The demands of shipbuilding for military use are even more rigorous. The steel must meet all the criteria discussed above, plus it must perform completely reliably under battle conditions. The United States Department of the Navy has specified properties which must be present in steels used in combatant ship hulls. These steels are known as Grade HY-80 and HY-100 steels.

Currently, the steels which satisfy the HY-80 and Hy-100 specifications are rolled, as well as cast, steels, primarily those strengthened by precipitation-hardening. However, stronger rolled steels often require new tooling for their fabrication due to their greater resistance to deformation and elongation. In addition, these steels are not easily weldable in harsh or emergency conditions due to their need for pre- and/or post-heat treatments.

Accordingly, there exists a need for a steel which meets the criteria for military shipbuilding, which is easily cast or shaped, and which is weldable even at low temperatures, and in the demanding conditions present at sea and in battle.

DISCLOSURE OF INVENTION

It is a primary objective of the present invention to produce a cast steel which possesses high strength, ductility, and toughness at low temperatures, and which is weldable over a wide temperature range without the need for pre- or post-heat treatments.

The present invention discloses a low-carbon cast steel which achieves high strength through the formation of fine precipitates regularly distributed throughout the matrix. The steel achieves its excellent ductility, weldability, and good toughness by the formation of vanadium nitrides and by the minimization of titanium, columbium (niobium), chromium, boron, tantalum, and cobalt precipitates.

More specifically, the present invention discloses a cast steel having the following composition, by weight:

0.07 to 0.12% carbon
0.20 to 0.60% silicon
0.90 to 1.20% manganese
0.30 to 0.50% molybdenum
0.05 to 0.10% vanadium
0.009 to 0.0125% nitrogen,
0.010% sulphur, max.
0.30% chromium, max.
0.30% nickel, max.
0.01% titanium, max.
0.35% copper, max.
0.07% aluminum, max.
0.015% phosphorus, max.
the remainder being essentially iron with incidental impurities.

The steel of the present invention exhibits excellent weldability, a yield strength of 65,000 to 95,000 psi (0.2% offset) [450 to 655 MPa], a tensile strength of 90,000 to 115,000 psi [620 to 795 MPA], and a breaking energy of 40 to 70 ft lbs [54 to 95 J] measured at −40° F. on a Charpy vee notch impact test bar.

BEST MODE FOR CARRYING OUT THE INVENTION

The properties of a steel depend on its elemental composition and on its grain structure. The composition is determined by the elements which are added to the melt, and the structure is dependent both on the composition and on the process used to manufacture the steel.

A modification in the composition of the steel may enhance one desirable property, and at the same time adversely affect another desirable property. For example, it has long been known that carbon increases the tensile strength of steel yet decreases its toughness and ductility. Similarly, silicon helps raise yield strength but has a detrimental effect on toughness.

The strength of steel can also be increased by the addition of certain elements which form precipitates or dispersoids throughout the matrix. Such steels are known as "high-strength, low-alloy" ["HSLA"] steels. Elements which have been used in HSLA steels include aluminum, columbium (niobium), vanadium, titanium, boron, cobalt, tantalum, and zirconium. These elements form precipitates by combining with nitrogen from the air, and in some cases also with carbon present in the steel. For this reason, a certain amount of nitrogen is required in the steel to allow precipitation of nitrides. On the other hand, too much nitrogen will ruin the steel by creating tiny voids which greatly weaken the steel and can lead to severe cracking and failure. In order to prevent the formation of nitrogen voids, steelmakers purposely limit the nitrogen content of the steel to approximately 65 to 90 ppm.

However, the steel of the present invention contains a nitrogen content of 90 to 150 ppm and does not suffer the effects of void formation. Moreover, the steel disclosed herein has a yield strength of 65,000 to 95,000 psi (0.2% offset) [450 to 655 MPA], a tensile strength of 90,000 to 115,000 psi [620 to 795 MPa], and a breaking energy of 40 to 70 ft lbs [54 to 95 J] measured at −40° F. on a Charpy vee notch impact test bar.

The inventor has achieved these properties not only by the unusual addition of nitrogen but also by minimizing the concentration of aluminum, columbium (niobium), titanium, chromium, boron, cobalt, tantalum, and zirconium. The inventor has determined that while these elements have been used to increase strength, they adversely effect toughness and weldability.

The present invention discloses a cast steel having the following composition, by weight:

0.07 to 0.12% carbon
0.20 to 0.60% silicon
0.90 to 1.20% manganese
0.30 to 0.50% molybdenum
0.05 to 0.10% vanadium
0.009 to 0.0125% nitrogen, 0.010% sulphur, max.
0.30% chromium, max.
0.30% nickel, max.
0.01% titanium, max.
0.35% copper, max.
0.07% aluminum, max.
0.015% phosphorus, max.
the remainder being essentially iron with incidental impurities.

The elemental composition of the present invention imparts hardness and strength without adversely affecting toughness or weldability. The carbon content is maintained at a low level to enhance toughness while maintaining ease of weldability. Similarly, a moderate silicon content helps increase the yield strength without decreasing toughness. Molybdenum and manganese contribute to the hardenability of the steel. Copper also increases structural hardness, while nickel increases toughness and enhances grain refinement. Vanadium and nitrogen are added for precipitation-hardening. Vanadium locks the interstitial nitrogen into the steel in the form of nitride or carbonitride precipitates. Chromium and titanium are minimized despite their precipitation-hardening effect due to their adverse effect on toughness. Notably absent from this steel are columbium, tantalum, tungsten, cobalt, zirconium, and boron, all of which decrease toughness and weldability.

The present invention achieves high strength by optimizing the concentration of hardening and strengthening agents, such as vanadium, while minimizing elements which decrease toughness and weldability, such as columbium and titanium. While vanadium has been used in *rolled* HSLA steels, its effect on a *cast* steel could not be predicted from information about rolled steels.

As noted above, the properties of a steel are dependent on its crystalline grain structure. The grain structure, in turn, depends on the elemental content and on grain-refining manufacturing techniques. In rolled steels, the grain is refined by thermomechanical treatments; the precipitates are distributed evenly throughout the steel by physical manipulations. In cast steels, however, the grain is refined only by heat treatments, a process known as "quenching and tempering."

Because of the different manufacturing processes used in *rolled* versus *cast* steels, one cannot apply the information learned from rolled steels to cast steels unless one also knows the role of each element in the steel; the kinetics of transformation, dissolution, and precipitation; requirements relating to melting and solidification in the foundry; and the effects of the rolling process under a variety of conditions as compared with the effects of the quenching and tempering process for varying ranges of time and temperature.

The following examples are offered by way of illustration and not by way of limitation. To summarize the examples which follow, Example I demonstrates the properties of a cast steel with the desired composition which was aged at 1075° F. for varying lengths of time. Example II illustrates the properties of cast steel with the desired composition which was aged at 1175° F. Example III demonstrates the properties of cast steel with the desired composition which was aged at 1275° F. Finally, Example IV illustrates the weldability properties of steels produced as in Examples I, II and III.

EXAMPLE I

Castings with the following composition were poured.

| | |
|---|---|
| C .10% | Mo .39% |
| S .005% | V .09% |
| Si .35% | Ti .005% |
| Mn 1.14% | Cu .12% |
| Cr .12% | Al .016% |
| Ni .08% | P .013% |
| | $N_2$ 129 ppm |

Coupons were cut from the castings and were treated at 1750° F. for 2 hours followed by air cool; heat treated at 1700° F. for 2 hours followed by water quench.

The coupons were aged at 1075° F. for 2, 4, and 6 hours. The sample coupons were tested to ASTM specifications. The properties are summarized in the following tables. The values shown are the averaged values of three samples.

TABLE I

| | 2 hours | 4 hours | 6 hours |
|---|---|---|---|
| Tensile Strength | 112,000 psi | 114,500 psi | 115,000 psi |
| Yield Strength | 97,500 psi | 100,000 psi | 102,500 psi |
| Elongation | 25.0% | 26.0% | 25.0% |
| R.A. (Reduction of Area) | 68.6% | 68.4% | 68.6% |

TABLE II

| Charpy Impact Test Results | 2 hours | 4 hours | 6 hours |
|---|---|---|---|
| −40° F. | 20 ft lbs | 20 ft lbs | 20 ft lbs |
| −50° F. | 29 ft lbs | 34 ft lbs | 40 ft lbs |
| −70° F. | 24 ft lbs | 38 ft lbs | 40 ft lbs |
| −82° F. | 18 ft lbs | 16 ft lbs | 22 ft lbs |
| −94° F. | 10 ft lbs | 15 ft lbs | 16 ft lbs |
| −95° F. | 7 ft lbs | 6 ft lbs | 9 ft lbs |

EXAMPLE II

Castings with the composition as in Example I were prepared. Coupons were cut from the castings and heat treated as in Example I. The coupons were aged at 1175° F. for 2, 4 and 6 hours. The sample coupons were tested to ASTM specifications. The properties are summarized in the following tables. Except where noted, the values shown are the averaged values of three samples.

TABLE III

| | 2 hours | 4 hours | 6 hours |
|---|---|---|---|
| Tensile Strength | 109,000 psi | 105,000 psi | 98,000 psi |
| Yield Strength | 100,500 psi | 96,000 psi | 90,000 psi |
| Elongation | 23.5% | 26.5% | 24.0% |
| R.A. | 70.6% | 71.0% | 73.0% |

TABLE IV

| Charpy Impact Test Results | 2 hours | 4 hours | 6 hours |
|---|---|---|---|
| −40° F. | 40 ft lbs | 40 ft lbs | 40 ft lbs |
| −50° F. | 44 ft lbs | 52 ft lbs | 48 ft lbs |
| −70° F. | 26 ft lbs | 40 ft lbs | 10 ft lbs |
| −82° F. | 15 ft lbs | 21 ft lbs | 22 ft lbs |
| −94° F. | 10 ft lbs | 10 ft lbs | 16 ft lbs |
| −95° F. | 7 ft lbs | 11 ft lbs | *22 ft lbs |

*One sample only

EXAMPLE III

Castings with the composition as in Example I were prepared. Coupons were cut from the castings and heat treated as in Example I. The coupons were aged at 1275° F. for 2, 4, and 6 hours. The sample coupons were tested to ASTM specifications. The properties are summarized in the following table. The values shown are the averaged values of three samples.

TABLE IV

| | 2 hours | 4 hours | 6 hours |
|---|---|---|---|
| Tensile Strength | 98,000 psi | 90,000 psi | 90,000 psi |
| Yield Strength | 87,500 psi | 77,000 psi | 77,000 psi |
| Elongation | 27.0% | 27.5% | 30.5% |
| R.A. | 72.7% | 72.9% | 74.7% |

EXAMPLE IV

Welding tests at ambient temperatures and at 0° F. were performed on coupons prepared in Examples I, II and III. The coupons showed no underbead cracking. At 0° F., the weld did exhibit some lack of penetration at the root on first pass. This is probably due to severe chill of the test block.

From the foregoing, it will be appreciated that, although specific embodiments of the invention have been described herein for purposes of illustration, various modifications may be made without deviating from the spirit and scope of the invention. Accordingly, the invention is not limited except as by the appended claims.

I claim:

1. A high-strength, cast, heat-treated steel alloy with a bainite microstructure having good weldability, ductility, and toughness at temperatures between 250° F. and −50° F., comprising the product which has been subjected to a process of casting and heat treating, wherein the alloy has an analysis, by weight, consisting of:

0.07 to 0.12% carbon,
0.20 to 0.60% silicon,
0.90 to 1.20% manganese,
0.30 to 0.50% molybdenum
0.50 to 0.10% vanadium,
0.009 to 0.015% nitrogen,
0.010 max. sulphur,
0.30% max. chromium,
0.30% max. nickel,
0.01% max. titanium,
0.35% max. copper,
0.07% max. aluminum, and
0.15% max. phosphorus, the remainder being essentially iron with incidental impurities.

2. The steel of claim 1 wherein the analysis, by weight, is consists of:

0.10% carbon,
0.35% silicon,
1.14% manganese,
0.38% molybdenum,
0.09% vanadium,
0.0129% nitrogen,
0.005% max. sulphur,
0.12% max. chromium,
0.08% max. nickel,
0.005% max. titanium,
0.12% max. copper,
0.016% max. aluminum, and
0.013% max. phosphorus, the remainder being essentially iron with incidental impurities.

3. A high-strength, cast, heat-treated steel alloy with a bainite microstructure having good weldability, ductility, and toughness at temperatures between 250° F. and −50° F., comprising the product which has been subjected to a process of casting, a first heat treating at a temperature between about 1650° F. and 1850° F. followed by air cooling, a second heat treating at a temperature between about 1600° F. and 1800° F. followed by water quenching, and tempering at a temperature between about 1075° F. and 1275° F. for 2 to 6 hours followed by water quenching, wherein the alloy has an analysis, by weight, consisting of:

0.07 to 0.12% carbon,
0.20 to 0.60% silicon,
0.90 to 1.20% manganese,
0.30 to 0.50% molybdenum
0.05 to 0.10% vanadium,
0.009 to 0.015% nitrogen,
0.010 max. sulphur,
0.30% max. chromium,
0.30% max. nickel,
0.01% max. titanium,
0.35% max. copper,
0.07% max. aluminum, and
0.15% max. phosphorus, the remainder being essentially iron with incidental impurities, and wherein the steel has the following properties, as a minimum:

(a) yield strength of about 65,000 to 95,000 psi (0.2% offset) (450 to 655 MPa);
(b) tensile strength of about 90,000 to 115,000 psi (620 to 795 MPa); and
(c) breaking energy of about 35 to 40 ft lbs (54 to 95 J) measured on a Charpy Vee notch impact test bar at −40° F.

4. The steel of claim 3 wherein the analysis, by weight, consists of:

0.10% carbon,
0.35% silicon,
1.14% manganese,
0.38% molybdenum,
0.09% vanadium,
0.0129% nitrogen,
0.005% max. sulphur,
0.12% max. chromium,
0.08% max. nickel,
0.005% max. titanium.
0.12% max. copper,
0.016% max. aluminum, and
0.013% max. phosphorus, the remainder being essentially iron with incidental impurities.

* * * * *